US006756569B2

(12) United States Patent
Bates et al.

(10) Patent No.: US 6,756,569 B2
(45) Date of Patent: Jun. 29, 2004

(54) TEMPERATURE SENSOR FOR HEATER UNIT IN COOKTOP RANGE

(75) Inventors: Jeffrey A. Bates, Vernon, AL (US); Christopher R. Taylor, Columbus, MS (US); James E. Small, Enfield, CT (US)

(73) Assignee: Emerson Electric Co., St. Louis, MO (US)

( * ) Notice: Subject to any disclaimer, the term of this patent is extended or adjusted under 35 U.S.C. 154(b) by 78 days.

(21) Appl. No.: 10/144,661

(22) Filed: May 13, 2002

(65) Prior Publication Data

US 2002/0185489 A1 Dec. 12, 2002

Related U.S. Application Data

(60) Provisional application No. 60/290,201, filed on May 11, 2001.

(51) Int. Cl.[7] ..... H05B 3/68

(52) U.S. Cl. ..... 219/461.1; 219/492; 338/25; 137/65.2

(58) Field of Search ..... 219/460.1, 461.1, 219/446.1, 492; 137/65.2; 338/25

(56) References Cited

U.S. PATENT DOCUMENTS

| | | | | | |
|---|---|---|---|---|---|
| 4,237,368 | A | * | 12/1980 | Welch | 219/449 |
| 4,466,460 | A | * | 8/1984 | Orcutt | 137/65.2 |
| 4,855,572 | A | * | 8/1989 | Wallgren et al. | 219/456 |
| 5,296,682 | A | * | 3/1994 | Wittauer et al. | 219/464 |
| 5,310,993 | A | * | 5/1994 | McWilliams et al. | 219/449 |
| 5,900,175 | A | * | 5/1999 | Kicherer et al. | 219/463 |
| 5,935,470 | A | * | 8/1999 | Deo et al. | 219/463.1 |
| 5,981,916 | A | * | 11/1999 | Griffiths et al. | 219/492 |
| 6,281,481 | B1 | * | 8/2001 | Tiemann | 219/446.1 |
| 6,444,958 | B1 | * | 9/2002 | Campbell | 219/460.1 |
| 6,617,956 | B1 | * | 9/2003 | Zitzman | 338/25 |
| 2003/0019863 | A1 | * | 1/2003 | Gratz et al. | 219/448.17 |

* cited by examiner

*Primary Examiner*—Ehud Gartenberg
*Assistant Examiner*—L Fastovsky
(74) *Attorney, Agent, or Firm*—Howrey Simon Arnold & White LLP

(57) ABSTRACT

A heating unit for use in a cooktop is disclosed. The heating unit includes a pan with an insulation structure supporting a heating element. The heating unit further includes a temperature sensor and indicator to be used as a visual indication to the user that the heating unit is energized.

26 Claims, 4 Drawing Sheets

TEMPERATURE SENSOR FOR HEATER UNIT IN COOKTOP RANGE

CROSS-REFERENCE TO RELATED APPLICATION

This application claims priority to U.S. Provisional Application Serial No. 60/290,201 filed on May 11, 2001 having the same title and naming the same inventors as identified herein.

FIELD OF THE INVENTION

The present invention relates generally to cooktops and, more particularly, to a temperature sensor for an electric heater unit in cooktop ranges.

SUMMARY OF THE INVENTION

In the prior art, there has been a need for a heating unit adapted to be installed in a cooktop that includes a means for alerting a user that the cooktop is energized and is, therefore, hot. Consequently, the present invention is directed to a heating unit that includes a bimetal temperature sensor mounted within the heating unit that is configured to activate a visual indicator when the heating element is providing heat to the heating surface. The heating unit also includes a support pan disposed beneath a heating surface, an insulation layer inside the pan, and a heating element supported on the insulation layer.

In various embodiments of a heating unit in accordance with the present invention, the insulation layer includes an insulation base and an insulation sidewall ring—the insulation base being supported by the support pan, and the insulation sidewall ring spacing the heating element apart from a glass-ceramic surface of the cooktop. The temperature sensor is disposed within an opening molded in the insulation layer and may be affixed by various means including ceramic paste. The heating unit also includes a terminal block, which may be affixed within an opening in the insulation layer or may be formed integrally with the insulation layer.

BRIEF DESCRIPTION OF THE DRAWINGS

Other objects and advantages of the invention will become apparent upon reading the following detailed description and upon reference to the drawings.

DESCRIPTION OF ILLUSTRATIVE EMBODIMENTS

Figure 1:
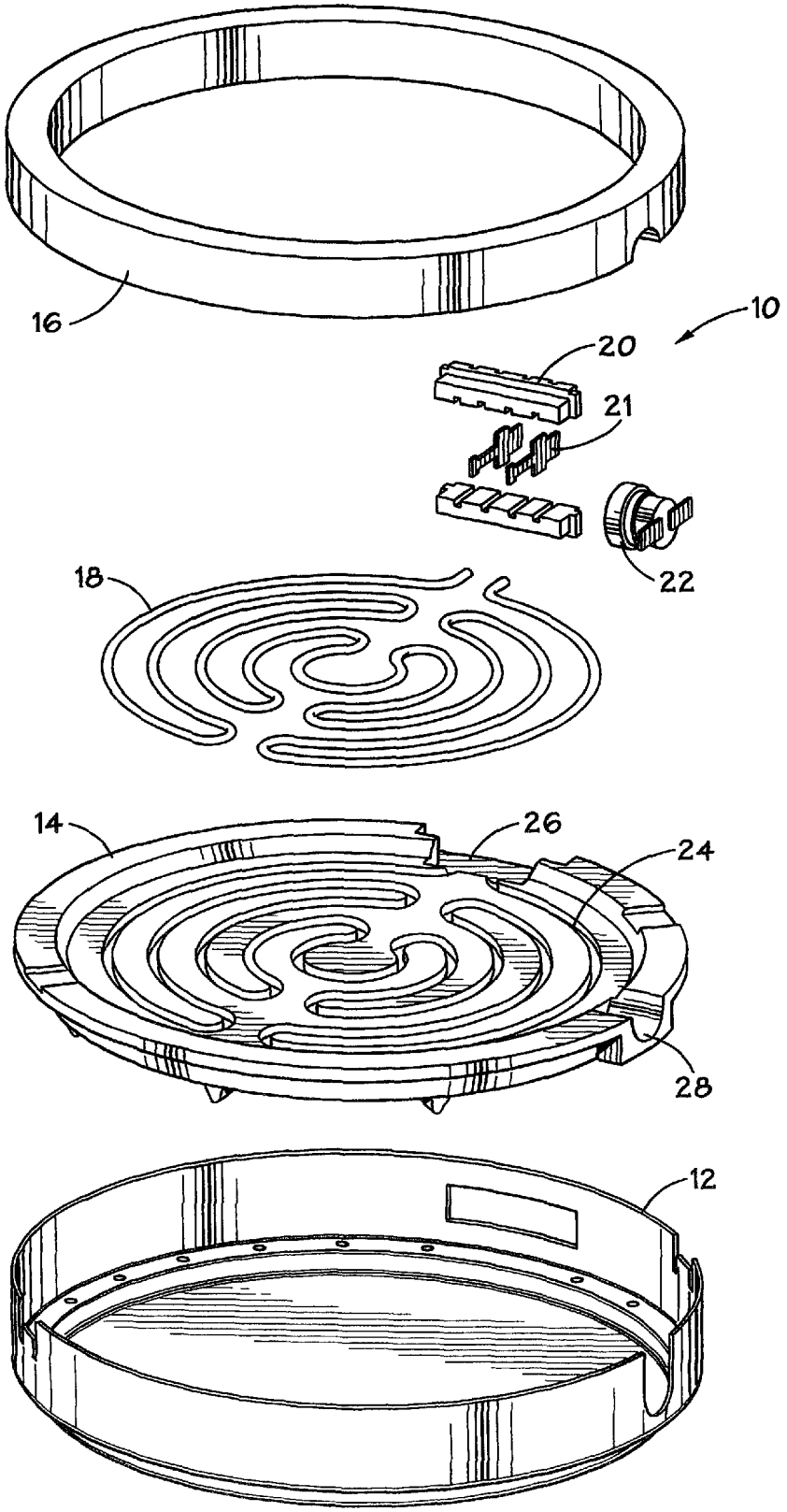
FIGS. 1, 2 and 3 are exploded views of a radiant heating unit in accordance with the present invention.
Figure 2:
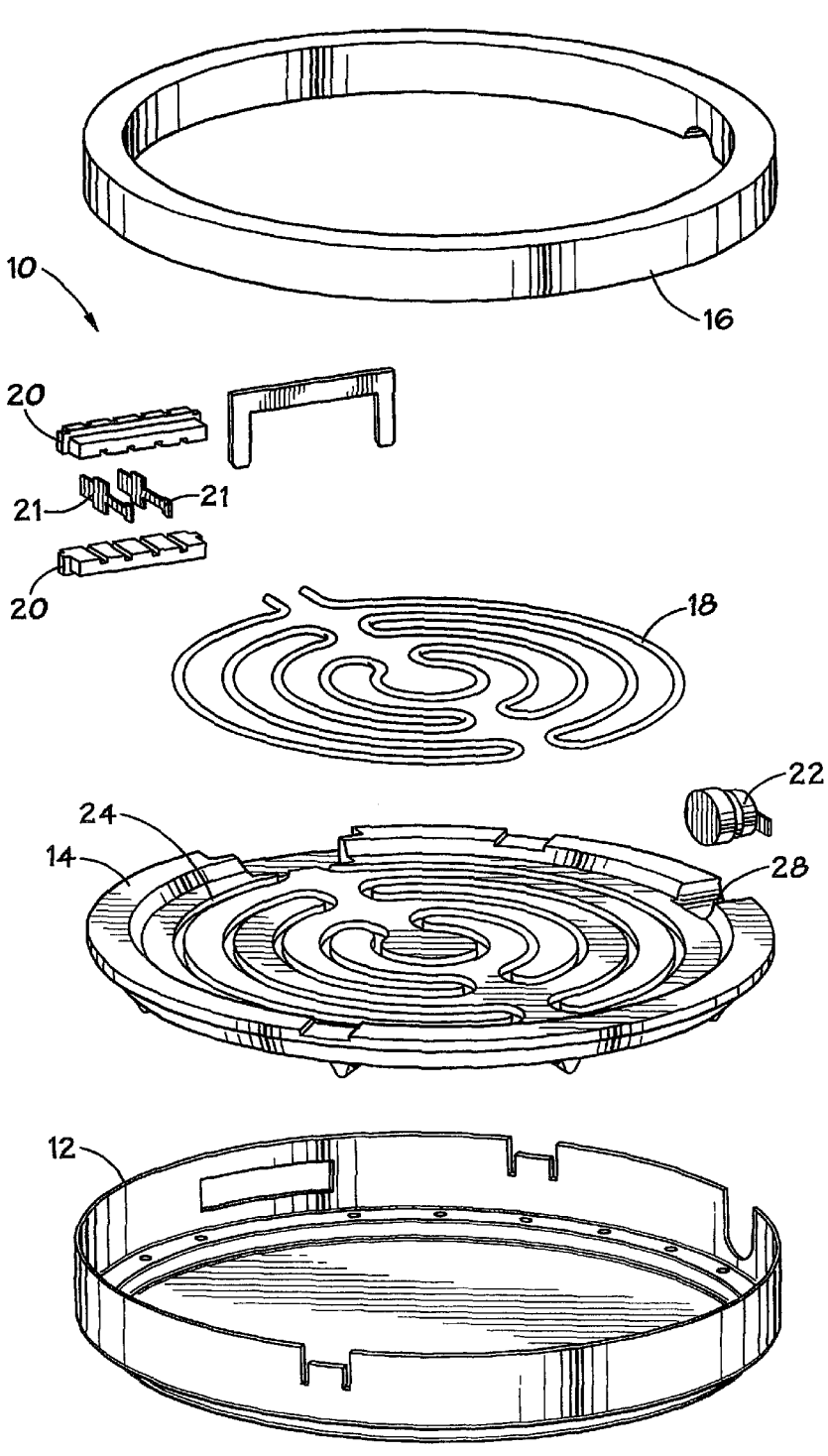

Illustrative embodiments will now be described with reference to the accompanying figures. Turning to the drawings, FIGS. 1 and 2 show a heating unit 10 having a temperature sensor of the present invention. The heating unit 10 is a radiant heater "warmer" and may be mounted underneath a heating surface (not shown) to produce heat to the heating surface. The heating unit 10 is simply turned on or off and has no user temperature control. The heating unit 10 is not capable of exceeding the heating surface temperature ratings and, therefore, does not require a conventional glass rod limiter.

In this embodiment, the heating unit 10 includes a support pan 12, an insulation layer having an insulation base 14 and an insulation sidewall ring 16, a heater element 18, a terminal block assembly 20, and a temperature sensor 22. As explained above, the heating unit 10 may be mounted underneath a heating surface to produce heat to the heating surface. The heating surface may be made of an infrared transmissive material such as glass-ceramic. A suitable material is designated as CERAN manufactured by Schott Glass in Mainz, Germany or EuroKera Glass Ceramic manufactured by EuroKera North America, Inc. in Fountain Inn, S.C.

The support pan 12 is disposed beneath the heating surface. The support pan 12 is a shallow pan having a substantially flat base and a circumferential sidewall. The insulation layer is supported inside the support pan 12. Specifically, in one embodiment as shown in FIGS. 1 and 2, the insulation layer has an insulation base 14 and an insulation sidewall ring 16. Although FIGS. 1 and 2 show the insulation layer as two separate components, the insulation base 14 and the sidewall ring 16 may be a single unitary body. Suitable materials for the insulation layer include steatite, cordierite and fused silica ceramics.

Figure 3:
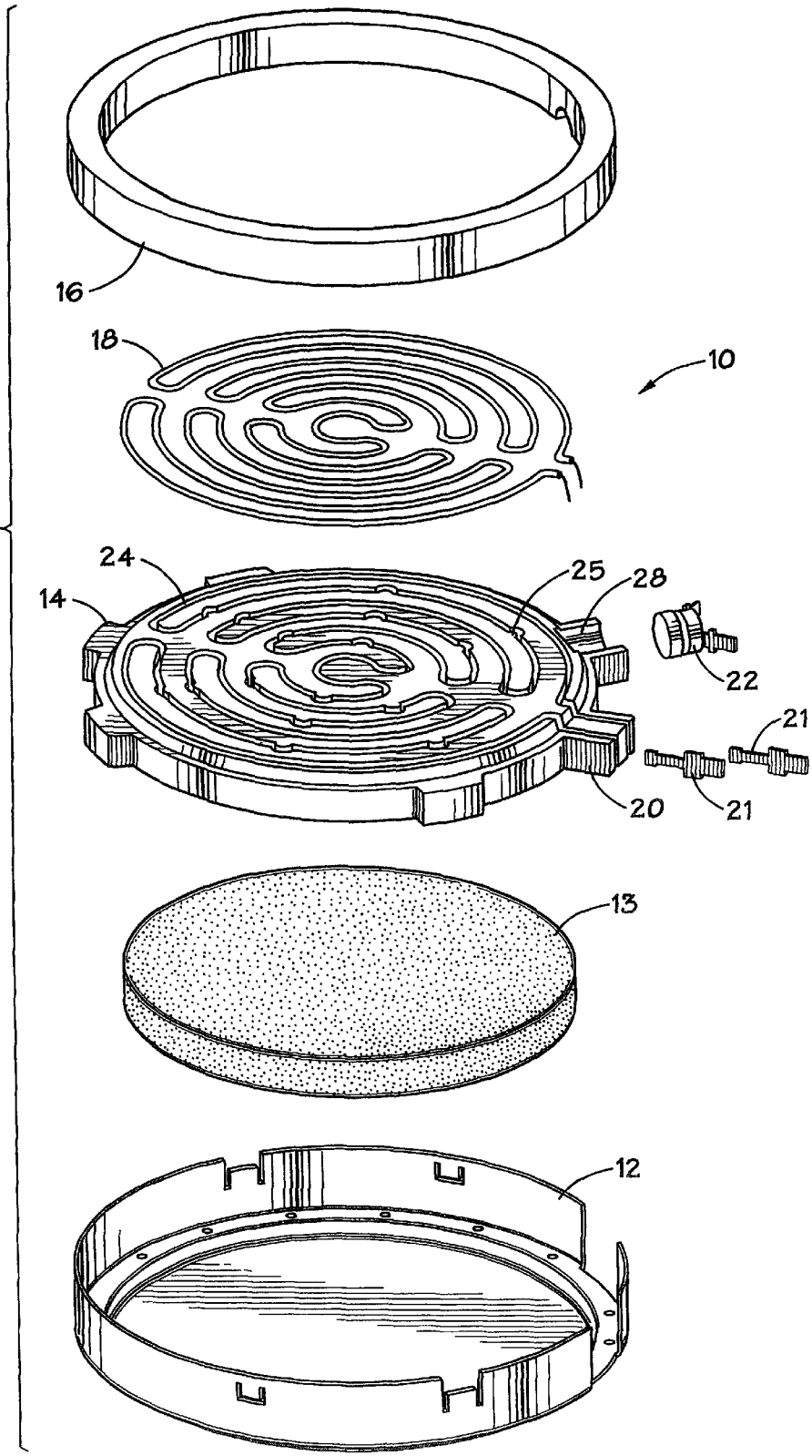
Figure 4:
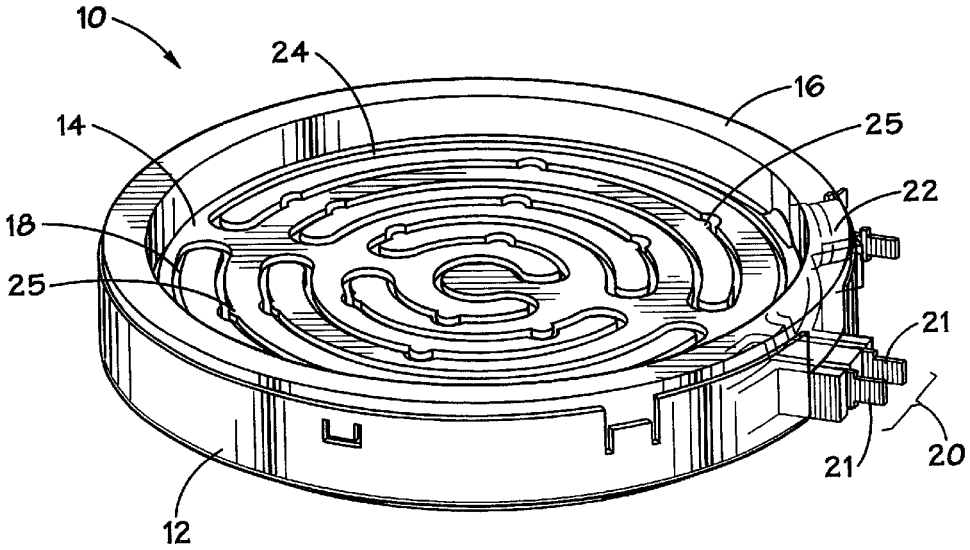
FIG. 4 is an assembled view of a radiant heating unit in accordance with the present invention.

An alternative embodiment, illustrated in FIGS. 3 and 4, further includes an insulation blanket 13 disposed between the insulation base 14 and the support pan 12. The insulation blanket may be made from any suitable insulation blanket material, such as Thermal Ceramics #607 blanket material. Because there are holes in the insulation base 12, the insulation blanket serves as an additional thermal and electrical barrier between the heating element 18 and the metal support pan 12.

The insulation base 14 has a top surface and a bottom surface. The top surface of the insulation base 14 may have grooves 24 shaped to receive the heating element 18. The heating element 18 is retained within the insulation base 14 by tabs 25 molded in the insulation base, as most clearly illustrated in FIG. 4. The top surface of the insulation base 14 also has an opening 26 for housing the terminal block assembly 20 and an opening 28 for housing the temperature sensor 22. The terminal block 20 and the temperature sensor 22 are affixed within the respective openings by a ceramic paste, such as that manufactured by Sauereisen Cement Company.

In an alternative embodiment illustrated in FIG. 3, the terminal block assembly 20 is molded as a unitary structure with insulation base 14. Terminals 21 are held within the terminal block assembly 20 by a ceramic paste.

The presence of the insulation sidewall ring 16 permits the heating element 18 to be in a spaced-apart relationship to the heating surface. The heating element 18 may be a ribbon-type heating element or a coiled or composite heater element. The heating element 18 radiates infrared energy. The heating element 18 has a serpentine or sinuous pattern when installed on the insulation base 14. It will be understood that the pattern shown in FIG. 1 is illustrative only and that the heating element 18 may be laid out in other patterns on the insulation base 14 without departing from the scope of the invention. The terminal block assembly 20 serves as a connector that allows for quick connection to and from the lines carrying the power to activate the heater element 18.

In one embodiment, the temperature sensor 22 mounts inside an opening 28 in the insulation base 14 and through the circumferential sidewall of the support pan 12. The temperature sensor 22 is a bimetal temperature sensor. One suitable bimetal temperature sensor is the 36T Button Thermostat from Thermo-O-Disc, Inc., Mansfield, Ohio. The temperature sensor 22 is electrically connected to a visual indicator on the cooktop range to tell a user that the "Glass is Hot." The temperature sensor 22 serves as a safety device and performs an important function of warning the user of the cooktop range to avoid touching the heating surface.

The benefit of using a bimetal temperature sensor over the prior art is that it provides a significant cost advantage over present designs that use a switched output of the more expensive glass rod limiter found in prior art heating units.

While the invention is susceptible to various modifications and alternative forms, certain specific embodiments thereof have been shown by way of example in the drawings and will be described in detail. It should be understood, however, that the intention is not to limit the invention to the particular forms described. On the contrary, the intention is to cover all modifications, equivalents and alternatives falling within the spirit and scope of the invention as defined by the appended claims.

What is claimed is:

1. A heating unit adapted to be installed in a cooktop having a heating surface and a visual indicator, the heating unit comprising:

a support pan disposed beneath the heating surface;

an insulation layer inside the pan;

a heating element supported on the insulation layer; and a bimetal temperature sensor mounted within the heating unit;

wherein the temperature sensor is configured to electrically activate the visual indicator when the heating element is providing heat to the heating surface.

2. The heating unit of claim 1, wherein the insulation layer further comprises an insulation base and an insulation sidewall ring, the insulation base being supported by the support pan.

3. The heating unit of claim 2, wherein the heating element is supported by the insulation base and spaced apart from the heating surface by the insulation sidewall ring.

4. The heating unit of claim 3, wherein the temperature sensor is disposed within an opening in the insulation base.

5. The heating unit of claim 4, wherein the temperature sensor is affixed within the opening by a ceramic paste.

6. The heating unit of claim 1, wherein the heating element is selected from the group consisting of; a ribbon-type heating element a coiled heating element and a composite heating element.

7. The heating unit of claim 1, further comprising a terminal block assembly affixed in an opening in the insulation layer.

8. The heating unit of claim 7, wherein the terminal block assembly is affixed within the opening by a ceramic paste.

9. A heating unit adapted to be installed in a cooktop having a heating surface and a visual indicator, the heating unit comprising:

a support pan disposed beneath the heating surface;

an insulation layer inside the pan and defining a recess;

an insulation blanket disposed between the pan and the insulation layer;

a heating element supported on the insulation layer; and a bimetal temperature sensor affixed within the recess in the insulation layer, wherein the temperature sensor is configured to electrically activate the visual indicator when the heating element is providing heat to the heating surface.

10. The heating unit of claim 9, wherein the temperature sensor is affixed within the recess by a ceramic paste.

11. The heating unit of claim 9 further comprising a terminal block assembly integral with the insulation layer.

12. The heating unit of claim 9, wherein the insulation layer further comprises an insulation base and an insulation sidewall ring, the insulation base being supported by the support pan.

13. The heating unit of claim 12, wherein the heating element is supported by the insulation base and spaced apart from the heating surface by the insulation sidewall ring.

14. The heating unit of claim 13, wherein the temperature sensor is disposed within an opening in the insulation base.

15. The heating unit of claim 14, wherein the temperature sensor is affixed within the opening by a ceramic paste.

16. The heating unit of claim 9, wherein the heating element is selected from the group consisting of: a ribbon-type heating element, a coiled heating element and a composite heating element.

17. The heating unit of claim 9, further comprising a terminal block assembly affixed in an opening in the insulation layer.

18. The heating unit of claim 17, wherein the terminal block assembly is affixed within the opening by a ceramic paste.

19. A heating unit adapted to be installed in a cooktop having a heating surface and a visual indicator, the heating unit comprising:

a support pan disposed beneath the heating surface;

an insulation layer inside the pan;

a heating element supported on the insulation layer; and a means for sensing temperature and electrically activating the visual indicator in response to heat generated by the heating element.

20. The heating unit of claim 19, wherein the temperature sensing means is mounted in an opening in the insulation layer and affixed with a ceramic paste.

21. The heating unit of claim 20, further comprising an insulation blanket disposed between the insulation layer and the support pan.

22. The heating unit of claim 21, further comprising a terminal block assembly.

23. The heating unit of claim 22, wherein the terminal block assembly is formed integrally with the insulation layer.

24. The heating unit of claim 22, wherein the terminal block assembly is affixed in an opening in the insulation layer by a ceramic paste.

25. The heating unit of claim 1, further comprising an insulation blanket disposed between the pan and the insulation layer.

26. The heating unit of claim 1, further comprising a terminal block assembly integral with the insulation layer.

* * * * *